US012638252B2

(12) United States Patent
Kurosawa et al.

(10) Patent No.: US 12,638,252 B2
(45) Date of Patent: May 26, 2026

(54) HEAT EXCHANGER AND METHOD FOR MANUFACTURING THE SAME

(71) Applicant: HONDA MOTOR CO., LTD., Tokyo (JP)

(72) Inventors: Yuta Kurosawa, Saitama (JP); Yasunari Kimura, Saitama (JP); Tsuneo Endo, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 121 days.

(21) Appl. No.: 18/615,429

(22) Filed: Mar. 25, 2024

(65) Prior Publication Data

US 2024/0328727 A1 Oct. 3, 2024

(30) Foreign Application Priority Data

Mar. 27, 2023 (JP) ..... 2023-049898

(51) Int. Cl.
*F28F 3/12* (2006.01)

(52) U.S. Cl.
CPC ..... *F28F 3/12* (2013.01)

(58) Field of Classification Search
CPC ..... F28F 3/12; F28F 7/02; F28D 1/05391; B33Y 80/00
See application file for complete search history.

(56) References Cited

U.S. PATENT DOCUMENTS 5,251,693 A * 10/1993 Zifferer ..... F28F 1/06 165/177
8,051,902 B2 * 11/2011 Kappes ..... F28D 7/0008 165/174
10,267,574 B2 * 4/2019 Oliva ..... F28F 9/02
2009/0056924 A1 * 3/2009 Inatomi ..... G21D 1/02 165/165
2017/0146305 A1 * 5/2017 Kuczek ..... F28F 9/0268
2018/0187984 A1 * 7/2018 Manzo ..... F28F 13/12
2019/0024989 A1 * 1/2019 Wilson ..... F28F 9/0214
2021/0381473 A1 12/2021 Endou et al.

FOREIGN PATENT DOCUMENTS

JP 2021-188872 A 12/2021
WO WO-03033985 A1 * 4/2003 ..... F28F 9/0278

* cited by examiner

*Primary Examiner* — Tho V Duong
(74) *Attorney, Agent, or Firm* — Paratus Law Group, PLLC

(57) ABSTRACT

A heat exchanger includes: a core portion; a first refrigerant flow path; and a second refrigerant flow path as defined herein, the first refrigerant flow path and the second refrigerant flow path are regularly arranged tubular flow paths, the first refrigerant flow path includes a plurality of first main flow paths extending in a first direction and arranged in a second direction perpendicular to the first direction, an introduction chamber as defined herein, and a discharge chamber as defined herein, and at least one of the introduction chamber and the discharge chamber is provided with a protection member extending in the first direction from an end opposite to the first main flow path in the first direction toward a direction away from the first main flow path and extending in the second direction.

7 Claims, 11 Drawing Sheets

HEAT EXCHANGER AND METHOD FOR MANUFACTURING THE SAME

CROSS-REFERENCE TO RELATED APPLICATION

This application is based on and claims priority under 35 USC 119 from Japanese Patent Application No. 2023-049898 filed on Mar. 27, 2023.

TECHNICAL FIELD

The present invention relates to a heat exchanger and a method for manufacturing the same.

BACKGROUND ART

Heat exchangers using various heat transfer methods have been widely used as devices for transferring heat between two fluids having different temperatures.

In recent years, researches and developments have been actively conducted that contribute to improvement in energy efficiency in order to allow more people to access affordable, reliable, sustainable and advanced energy. In a heat exchanger, improvement in heat exchange efficiency is required in order to contribute to improvement in energy efficiency.

Further, recently, a technique related to an additive manufacturing method of forming a shape by additive manufacturing a material has progressed, and by using the additive manufacturing method, it is possible to manufacture a product having a complicated three-dimensional shape which is difficult to form using the conventional cutting, forging, punching, and the like. Also for the heat exchanger, it is possible to manufacture a heat exchanger having a complicated three-dimensional shape by manufacturing using the additive manufacturing method. JP2021-188872A describes a heat exchanger that is not only lightweight and cost-reduced but also has a new function by being manufactured using an additive manufacturing method.

SUMMARY OF INVENTION

However, in the heat exchanger described in JP2021-188872A, particularly when a refrigerant flowing an inside of the heat exchanger is gas, foreign matter may enter the heat exchanger together with the refrigerant, and the inside of the heat exchanger may be damaged by the foreign matter. In addition, when a component for preventing foreign matter from entering the heat exchanger is provided outside the heat exchanger in order to prevent the foreign matter from entering the heat exchanger, a problem arises in that the number of components increases.

The present invention provides a heat exchanger capable of preventing foreign matter from entering a refrigerant flow path without increasing the number of components of the heat exchanger, and a method for manufacturing the same.

The present invention relates to a heat exchanger, including:

a core portion;

a first refrigerant flow path provided in the core portion and configured to allow a first fluid to flow therethrough; and a second refrigerant flow path provided in the core portion and configured to allow a second fluid to flow therethrough, in which in the core portion, the first fluid flowing through the first refrigerant flow path and the second fluid flowing through the second refrigerant flow path exchange heat via a partition wall, the first refrigerant flow path and the second refrigerant flow path are regularly arranged tubular flow paths, the first refrigerant flow path includes a plurality of first main flow paths extending in a first direction and arranged in a second direction perpendicular to the first direction, an introduction chamber provided at a first end of the plurality of first main flow paths on one side in the first direction, communicating with the plurality of first main flow paths, and extending in the second direction, and a discharge chamber provided at a second end of the plurality of first main flow paths on the other side in the first direction, communicating with the plurality of first main flow paths, and extending in the second direction, and at least one of the introduction chamber and the discharge chamber is formed with a protection member extending in the first direction from an end opposite to the first main flow path in the first direction toward a direction away from the first main flow path and extending in the second direction.

In addition, the present invention relates to a method for manufacturing the above heat exchanger, the method including:

integrally forming the core portion including the first refrigerant flow path, the second refrigerant flow path, and the protection member by additive manufacturing a material.

According to the present invention, it is possible to prevent foreign matter from entering the second refrigerant flow path without increasing the number of components of the heat exchanger.

DETAILED DESCRIPTION OF THE INVENTION

Figure 1:
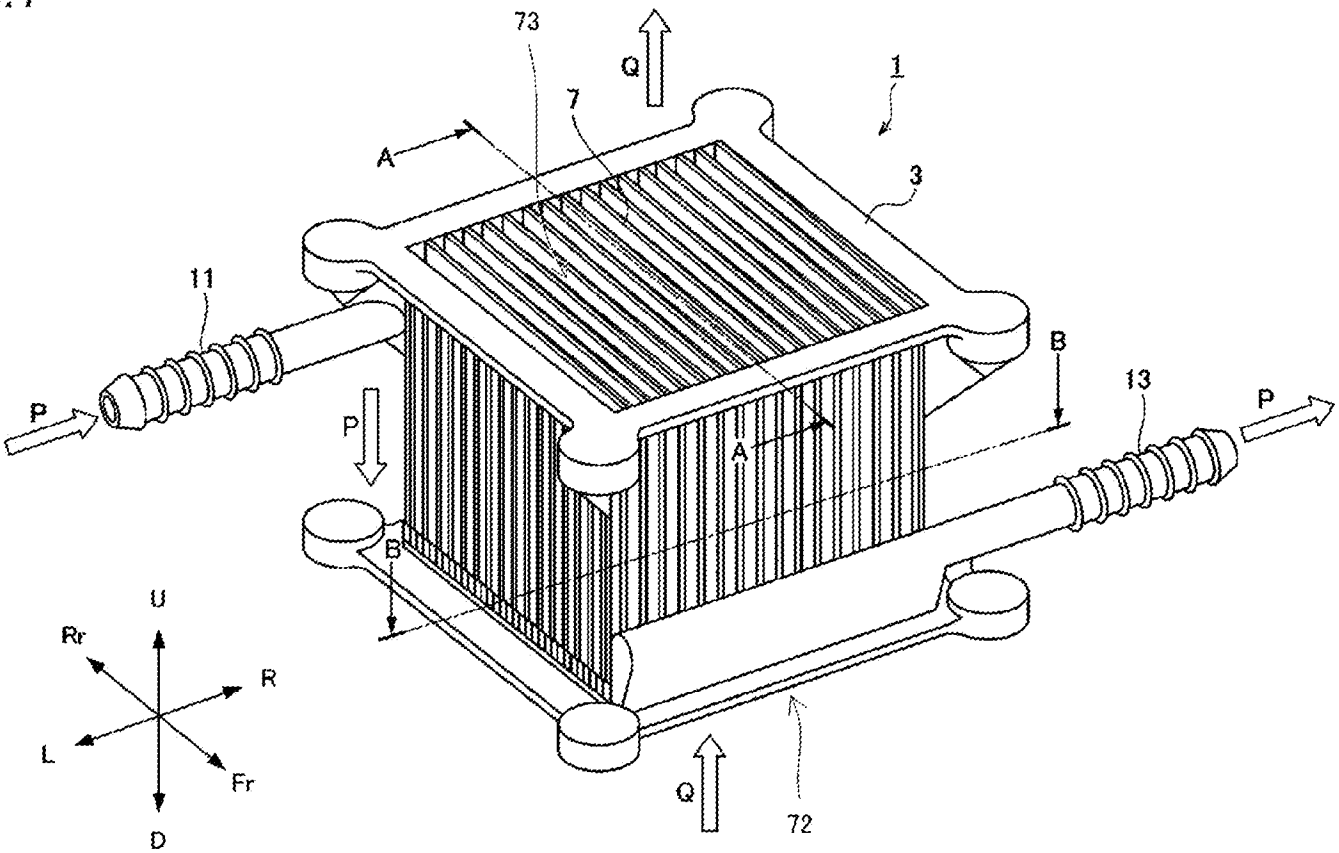
FIG. 1 is a perspective view of a radiator 1.

Hereinafter, an embodiment of a heat exchanger according to the present invention will be described with reference to the accompanying drawings. The drawings are viewed in directions of reference numerals. The heat exchanger is a device that allows a first fluid to be cooled and a second fluid that cools the first fluid to exchange heat via a partition wall. Properties of the first fluid and the second fluid are not particularly limited, and include all combinations such as gases, liquids, and gases and liquids. The first fluid and the second fluid are, for example, water, oil, an organic medium, air, or helium gas. In addition, a device on which the heat exchanger is mounted is not particularly limited, and includes all products such as a vehicle, a general-purpose device, an aircraft, and a home appliance. In the following embodiment, a radiator mounted on a vehicle will be described as an example of the heat exchanger according to the present invention. That is, in the following embodiment, the first fluid is cooling water for cooling a drive source of a vehicle, and the second fluid is air (traveling wind).

Figure 2:
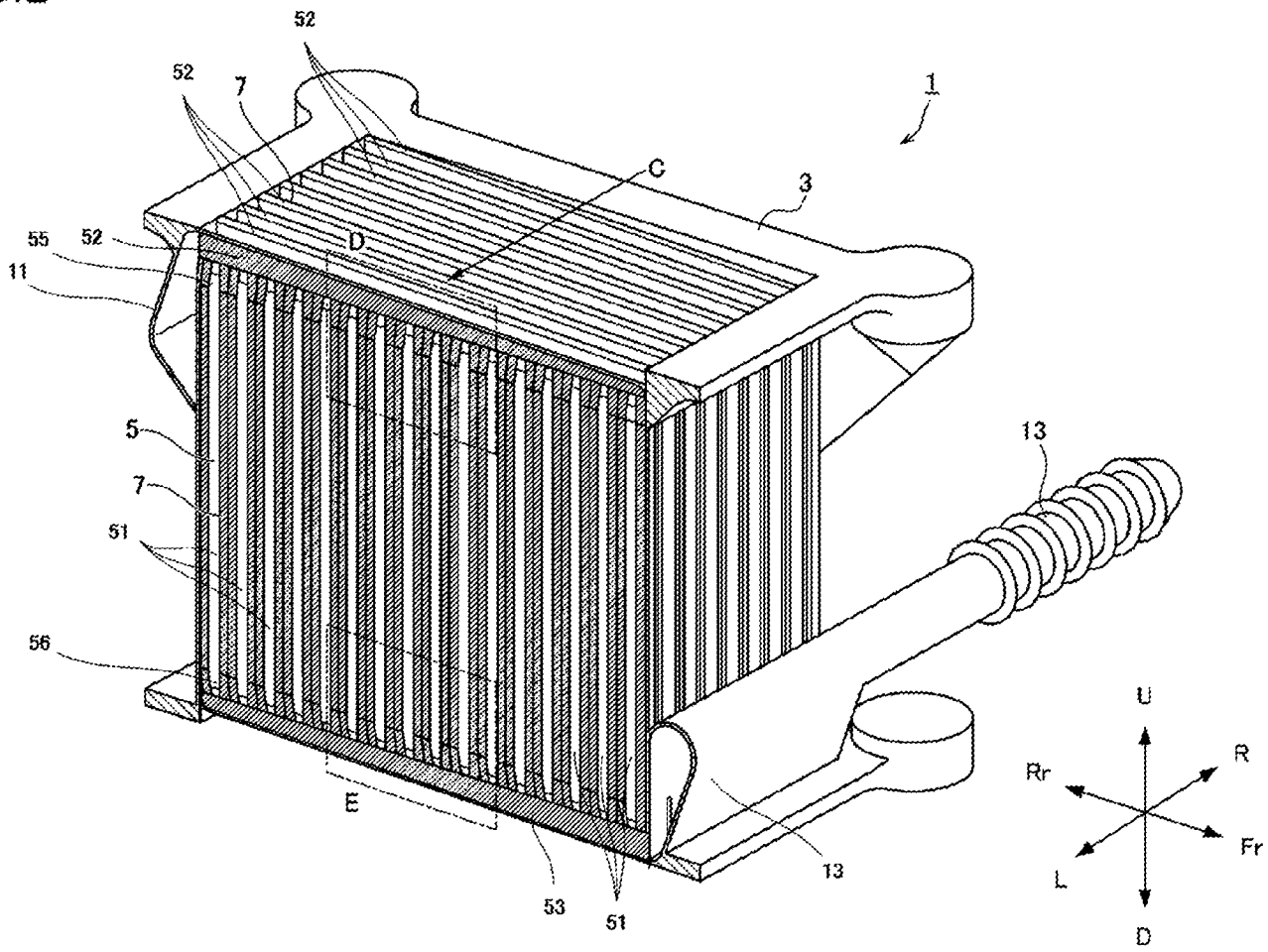
FIG. 2 is a partial perspective view in which a cross section along a line A-A in FIG. 1 is exposed.
Figure 3:
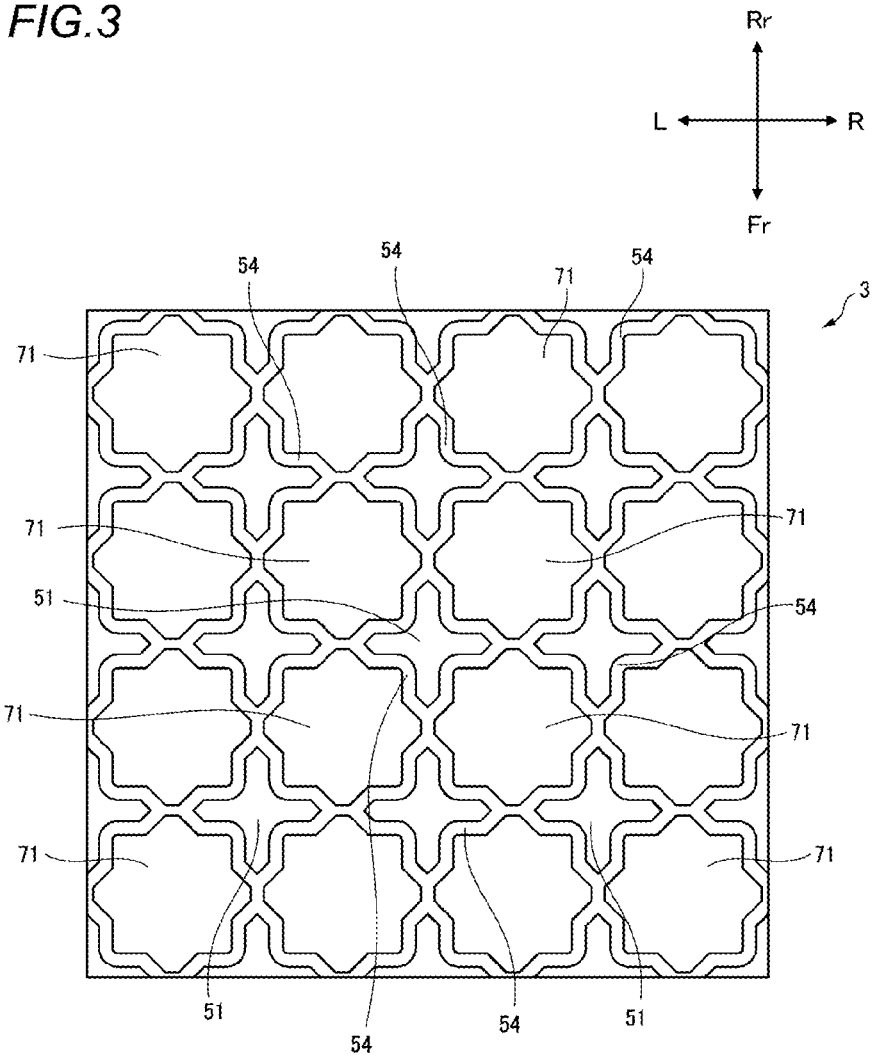
FIG. 3 is a partial cross-sectional view showing a part of a cross section taken along a line B-B in FIG. 1.

FIG. 1 is a perspective view of a radiator 1 according to an embodiment of the present invention. FIG. 2 is a partial perspective view of the radiator 1 of FIG. 1 in which a cross section taken along a line A-A in FIG. 1 is exposed. FIG. 3 is a partial cross-sectional view showing a part of a cross section taken along a line B-B in FIG. 1. In the present specification, in order to simplify and clarify the description, the radiator 1 will be described using an orthogonal coordinate system in three directions, that is, a front-rear direction, a left-right direction, and an upper-lower direction, as shown in FIG. 1. However, it should be noted that the direction is not related to a direction in which the radiator 1 is mounted on a device. In the drawings, an upper side is shown as U, a lower side is shown as D, a left side is shown as L, a right side is shown as R, a front side is shown as Fr, and a rear side is shown as Rr.

The radiator 1 includes a core portion 3, a first refrigerant flow path 5 provided in the core portion 3 and configured to allow cooling water to flow therethrough, and a second refrigerant flow path 7 provided in the core portion 3 and configured to allow air to flow therethrough. In the radiator 1, in the core portion 3, the cooling water flowing through the first refrigerant flow path 5 and the air flowing through the second refrigerant flow path 7 exchange heat via partition walls 54 to be described later. Therefore, there is a difference from a conventional plate type product in which a fluid is separated by a flat plate (heat transfer fins may be added), a fin tube type product in which heat is exchanged via heat conduction using flat plate fins around a circular tube, and the like. In the core portion 3, an introduction pipe 11 is provided on an upper portion of a rear surface, and a discharge pipe 13 is provided on a lower portion of a front surface. The introduction pipe 11 and the discharge pipe 13 communicate with the first refrigerant flow path 5 of the core portion 3.

As indicated by an arrow P, the cooling water is introduced into the core portion 3 from the outside through the introduction pipe 11 provided on the core portion 3, flows from above to below through the first refrigerant flow path 5 in the core portion 3, and then is discharged to the outside through the discharge pipe 13 provided on the core portion 3. On the other hand, as indicated by an arrow Q, the air is introduced into the core portion 3 from a lower surface of the core portion 3, flows from below to above through the second refrigerant flow path 7 in the core portion 3, and then is discharged from an upper surface of the core portion 3. The first refrigerant flow path 5 and the second refrigerant flow path 7 are regularly arranged tubular flow paths. Here, the tubular flow path refers to a pipe-like flow path having a closed cross-sectional shape of a circular arc or a polygon.

As shown in FIG. 2, the first refrigerant flow path 5 includes a plurality of first main flow paths 51 extending in an upper-lower direction and arranged in a front-rear direction, an introduction chamber 52 extending in the front-rear direction and communicating with the plurality of first main flow paths 51 arranged in the front-rear direction, and a discharge chamber 53 extending in the front-rear direction and communicating with the plurality of first main flow paths 51 arranged in the front-rear direction. In the first refrigerant flow path 5, when the plurality of first main flow paths 51 arranged in the front-rear direction and the introduction chamber 52 and the discharge chamber 53 that communicate with the first main flow paths 51 are defined as one set, a plurality of rows of these sets are provided in a left-right direction. Therefore, as shown in FIG. 3, the first main flow paths 51 are regularly arranged in a grid pattern in a cross section viewed from the upper-lower direction.

In the present embodiment shown in FIG. 3, the first main flow path 51 has a cross-shaped flow path cross section in which a space extending in the front-rear direction and a space extending in the left-right direction intersect in a cross shape. A shape of the first main flow path 51 is not limited thereto, and may be any shape such as a square, a rectangle, a diamond, a trapezoid, a circle, an ellipse, a star, a triangle, a polygon of pentagon or more, and other geometric patterns.

The introduction chamber 52 communicates with the introduction pipe 11, and the discharge chamber 53 communicates with the discharge pipe 13.

In the first main flow path 51, as shown in FIG. 2, an introduction side shape changing section 55 having a flow path cross-sectional shape gradually changing toward the introduction chamber 52 and linearly connected to the adjacent first main flow path 51 is provided at an upper end, and a discharge side shape changing section 56 having a flow path cross-sectional shape gradually changing toward the discharge chamber 53 and linearly connected to the adjacent first main flow path 51 is provided at a lower end. The introduction side shape changing section 55 and the discharge side shape changing section 56 will be described later.

As shown in FIG. 3, the second refrigerant flow path 7 includes a plurality of second main flow paths 71 formed by being surrounded by the partition walls 54 that define the first main flow paths 51. The second main flow path 71 extends in the upper-lower direction, is surrounded by the first main flow paths 51 of the first refrigerant flow path 5, and is present in plurality in the front-rear direction and the left-right direction. Therefore, the plurality of second main flow paths 71 are regularly arranged in a grid pattern in the front-rear direction and the left-right direction in the cross section viewed from the upper-lower direction. That is, in the second refrigerant flow path 7, when the plurality of second main flow paths 71 extending in the upper-lower direction and arranged in the front-rear direction are defined as one set, a plurality of rows of these sets are provided in the left-right direction.

A lower end surface of the core portion 3 is formed with an introduction port 72 for introducing the air into each of the second main flow paths 71 arranged in a grid pattern in the front-rear direction and the left-right direction. An upper end surface of the core portion 3 is formed with a discharge port 73 for discharging the air flowing through each of the second main flow paths 71 arranged in a grid pattern in the front-rear direction and the left-right direction.

The air introduced into the introduction port 72 from below the core portion 3 passes through spaces between a plurality of discharge chambers 53 arranged in the left-right direction, and is introduced into a lower end of the second main flow path 71 of the second refrigerant flow path 7 from below.

The air introduced into the second main flow path 71 of the second refrigerant flow path 7 flows from below to above, passes through spaces between a plurality of introduction chambers 52 arranged in the left-right direction from an upper end of the second main flow path 71, and is discharged above the core portion 3 from the discharge port 73.

Hereinafter, the introduction side shape changing section 55 provided at the upper end of the first main flow path 51 of the first refrigerant flow path 5 will be described in detail with reference to FIGS. 4 to 7. Since the discharge side shape changing section 56 provided at the lower end of the first main flow path 51 of the first refrigerant flow path 5 has the same structure as that of the introduction side shape changing section 55, a detailed description thereof will be omitted.

The introduction side shape changing section 55 of the first main flow path 51 has the flow path cross-sectional shape gradually changing toward the introduction chamber 52 and is linearly connected to the adjacent first main flow path 51.

Figure 4:
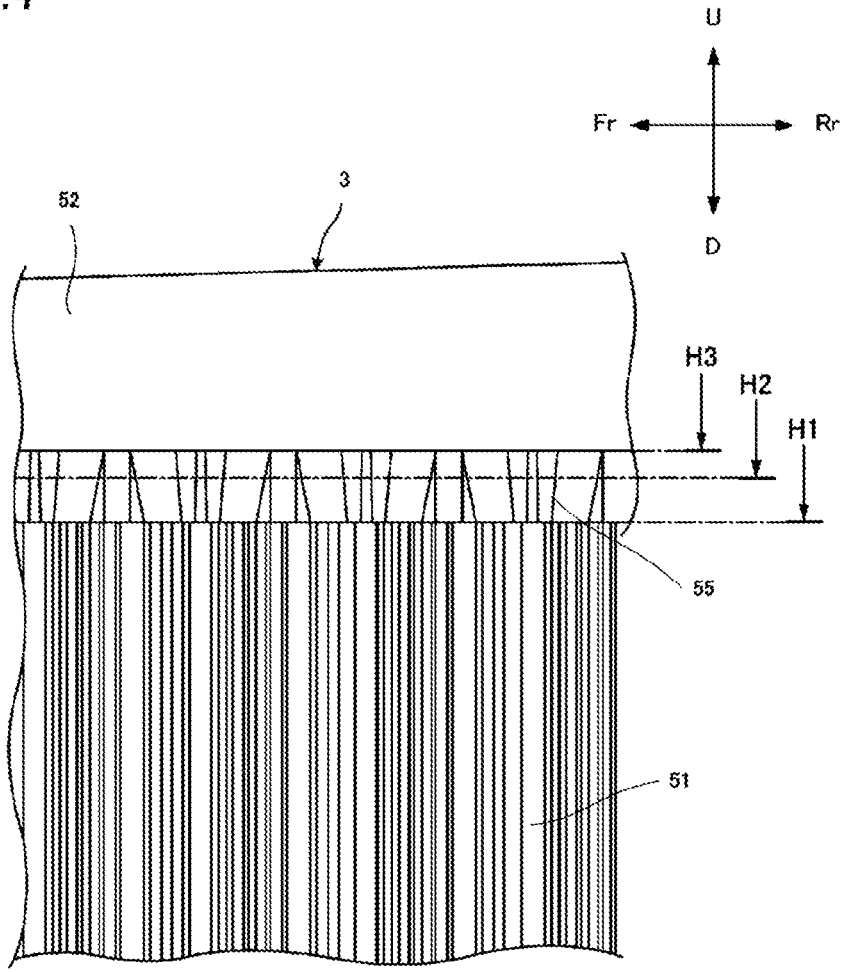
FIG. 4 is a view of a region D in FIG. 2 viewed from a direction C.
Figure 5:
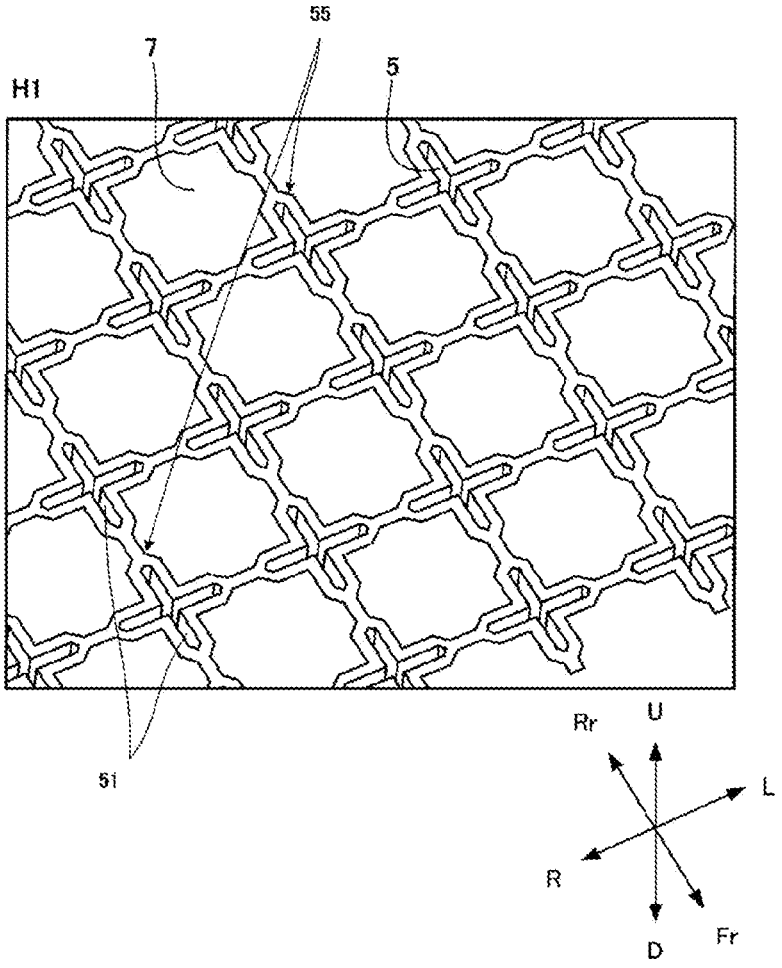
FIG. 5 is a partially enlarged view of a cross-sectional perspective view of the region D in FIG. 4 at an upper-lower direction position H1.
Figure 7:
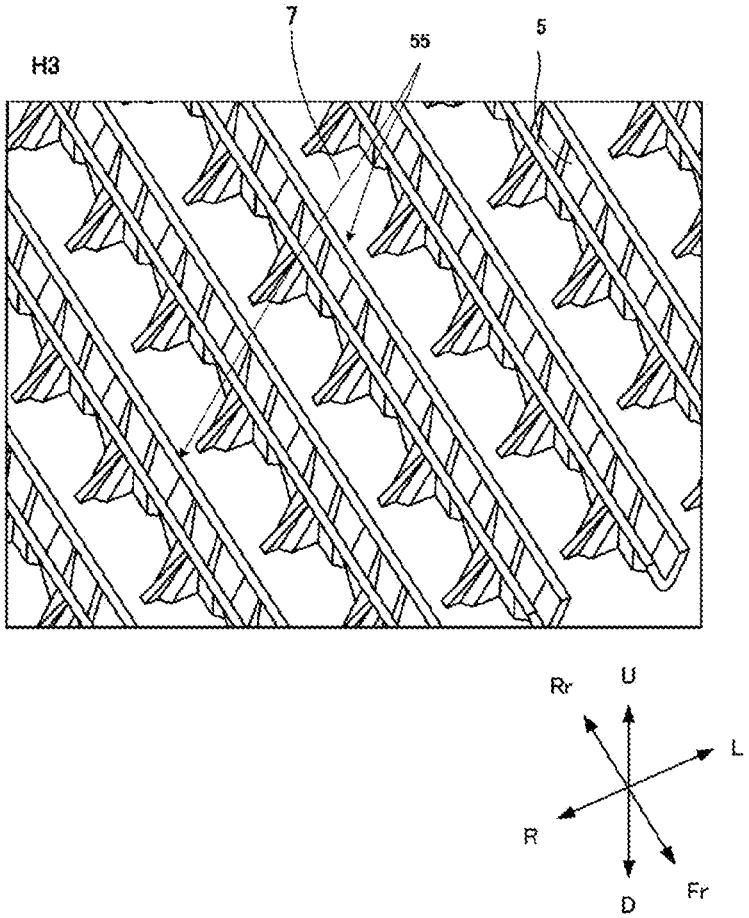
FIG. 7 is a partially enlarged view of a cross-sectional perspective view of the region D in FIG. 4 at an upper-lower direction position H3.
Figure 8:
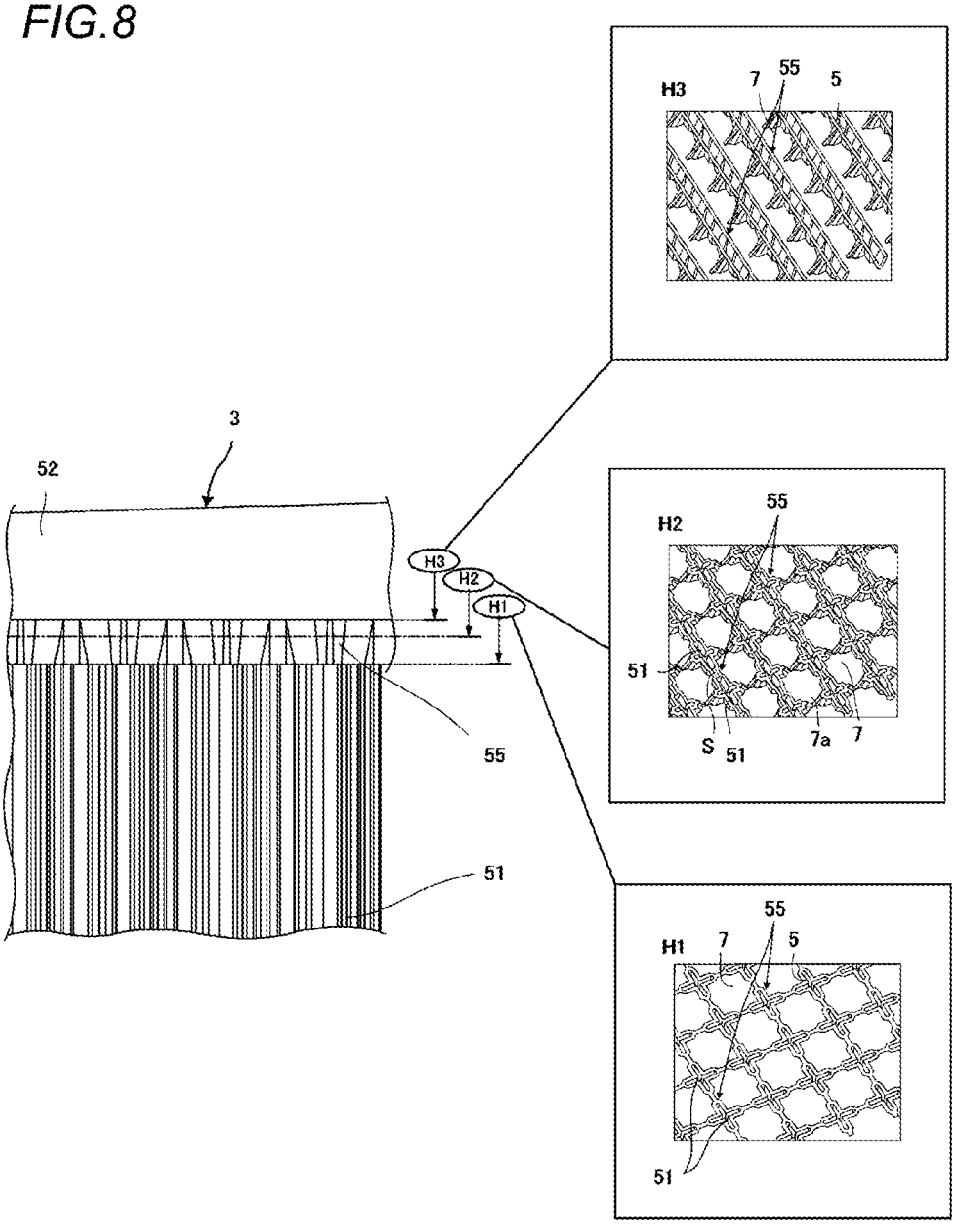
FIG. 8 is a view summarizing the cross-sectional perspective views of the region D in FIG. 4 at the upper-lower direction positions H1, H2, and H3.

FIG. 4 is a view of a region D in FIG. 2 viewed from a direction C. The region D is a region corresponding to upper ends of the first refrigerant flow path 5 and the second refrigerant flow path 7. FIG. 5 shows a partially enlarged view of a cross-sectional perspective view at an upper-lower direction position H1 in FIG. 4. Similarly, FIG. 6 shows a partially enlarged view of a cross-sectional perspective view at an upper-lower direction position H2 in FIG. 4, FIG. 7 shows a partially enlarged view of a cross-sectional perspective view at an upper-lower direction position H3 in FIG. 4, and FIG. 8 is a view summarizing the cross-sectional perspective views of the region D in FIG. 4 at the upper-lower direction positions H1, H2, and H3.

A partially enlarged view H1 shown in FIG. 5 shows an enlarged view at the lowermost upper-lower direction position H1 among the three enlarged views, and shows a start point of the introduction side shape changing section 55. At the upper-lower direction position H1, the first refrigerant flow path 5 has a shape shown in FIG. 3. That is, the first main flow path 51 of the first refrigerant flow path 5 has a cross-shaped flow path cross section. The first main flow paths 51 adjacent to each other in the front-rear direction and the left-right direction are independent of each other.

Figure 6:
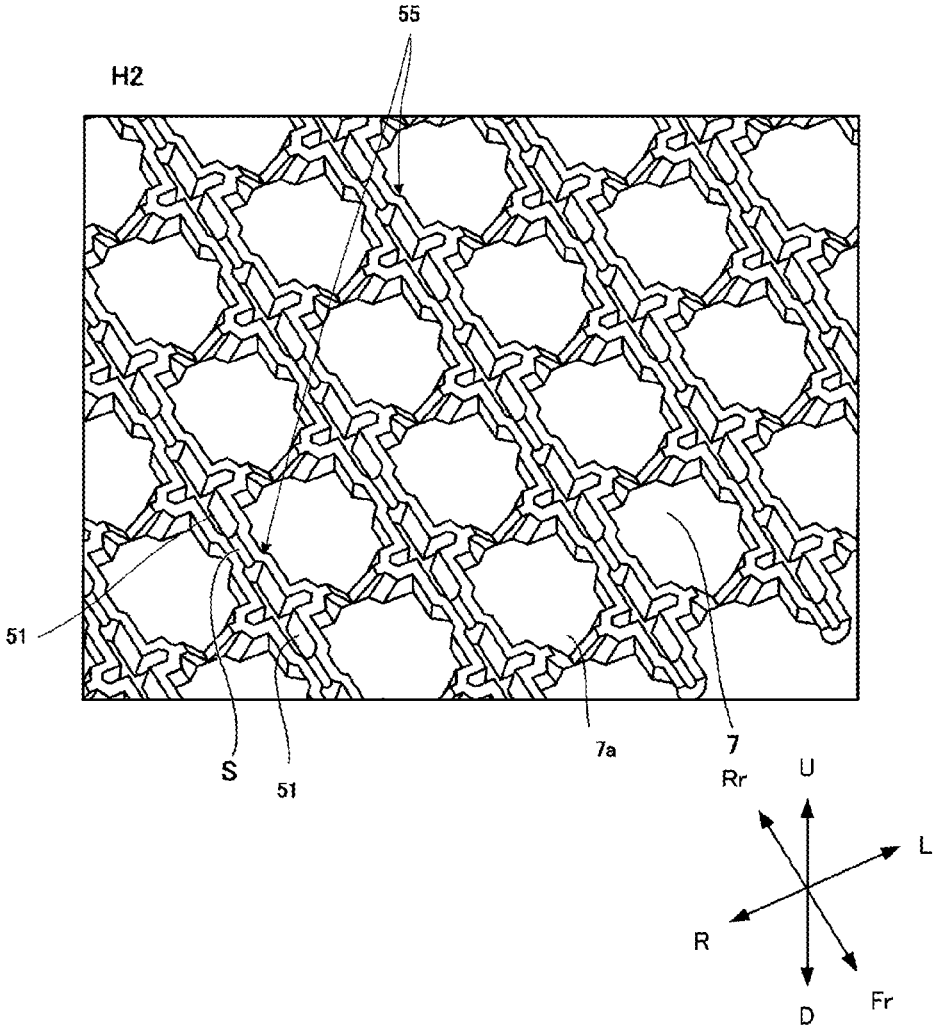
FIG. 6 is a partially enlarged view of a cross-sectional perspective view of the region D in FIG. 4 at an upper-lower direction position H2.

A partially enlarged view H2 shown in FIG. 6 shows an enlarged view at the middle upper-lower direction position H2 among the three enlarged views, and shows a middle part of the introduction side shape changing section 55. A flow path cross section at the upper-lower direction position H2 becomes wider as a length of a flow path extending in the front-rear direction becomes longer, and becomes narrower as a length of a flow path extending in the left-right direction becomes shorter from the cross-shaped flow path cross section (FIG. 5) at the upper-lower direction position H1 toward the introduction chamber 52 (upward). A communication path S is gradually provided between the first main flow paths 51 adjacent to each other in the front-rear direction. The flow path cross section at the upper-lower direction position H2 becomes wider as the length of the flow path extending in the front-rear direction becomes longer, and becomes narrower as the length of the flow path extending in the left-right direction becomes shorter further toward the introduction chamber 52 (upward).

Here, a cross-sectional area of the flow path cross section of the first main flow path 51 is the same in the introduction side shape changing section 55. That is, a flow path cross-sectional shape gradually changes in the introduction side shape changing section 55, but the cross-sectional area of the flow path cross section does not change. Therefore, the cooling water can flow more smoothly, and occurrence of a pressure loss is prevented.

A partially enlarged view H3 shown in FIG. 7 shows an enlarged view at the uppermost upper-lower direction position H3 among the three enlarged views, and shows an end point of the introduction side shape changing section 55. A flow path cross section at the upper-lower direction position H3 is connected to the adjacent first main flow path 51 and forms a straight line in the front-rear direction. That is, the communication path S cannot be distinguished from the flow path extending in the front-rear direction, and the flow path extending in the left-right direction disappears. The linear flow path shown in FIG. 7 communicates with the introduction chamber 52 located further above.

In this way, due to the introduction side shape changing section 55, the flow path cross section of the first main flow path 51 gradually changes and is linearly connected to the adjacent first main flow path 51, and communicates with the introduction chamber 52, so that a space having a predetermined width in the left-right direction and communicating with the plurality of second main flow paths 71 arranged in the front-rear direction extends in the front-rear direction between the introduction chambers 52 adjacent to each other in the left-right direction. Then, the air discharged from the second main flow path 71 of the second refrigerant flow path 7 is discharged to the outside from the discharge port 73 through this space, and does not hinder the flow of the air discharged from the second main flow path 71 of the second refrigerant flow path 7. Therefore, even if the introduction chamber 52 is disposed in a flow path space of the air from the discharge port 73 to the second main flow path 71, the flow of the air is not blocked.

Although the detailed description is omitted, similarly, the discharge side shape changing section 56 of the first main flow path 51 has the flow path cross-sectional shape gradually changing toward the discharge chamber 53 and is linearly connected to the adjacent first main flow path 51. In this way, due to the discharge side shape changing section 56, the flow path cross section of the first main flow path 51 gradually changes and is linearly connected to the adjacent first main flow path 51, and communicates with the discharge chamber 53, so that a space having a predetermined width in the left-right direction and communicating with the plurality of second main flow paths 71 arranged in the front-rear direction extends in the front-rear direction between the discharge chambers 53 adjacent to each other in the left-right direction. Then, the air introduced from the introduction port 72 is introduced into the second main flow path 71 of the second refrigerant flow path 7 through this space, and does not hinder the flow of the air introduced from the introduction port 72. Therefore, even if the discharge chamber 53 is disposed in a flow path space of the air from the introduction port 72 to the second main flow path 71, the flow of the air is not blocked.

In addition, in the introduction side shape changing section 55 and the discharge side shape changing section 56, by changing only the shape while maintaining the same cross-sectional area of the flow path cross section, it is possible to avoid an increase in the pressure loss of the cooling water.

Figure 9:
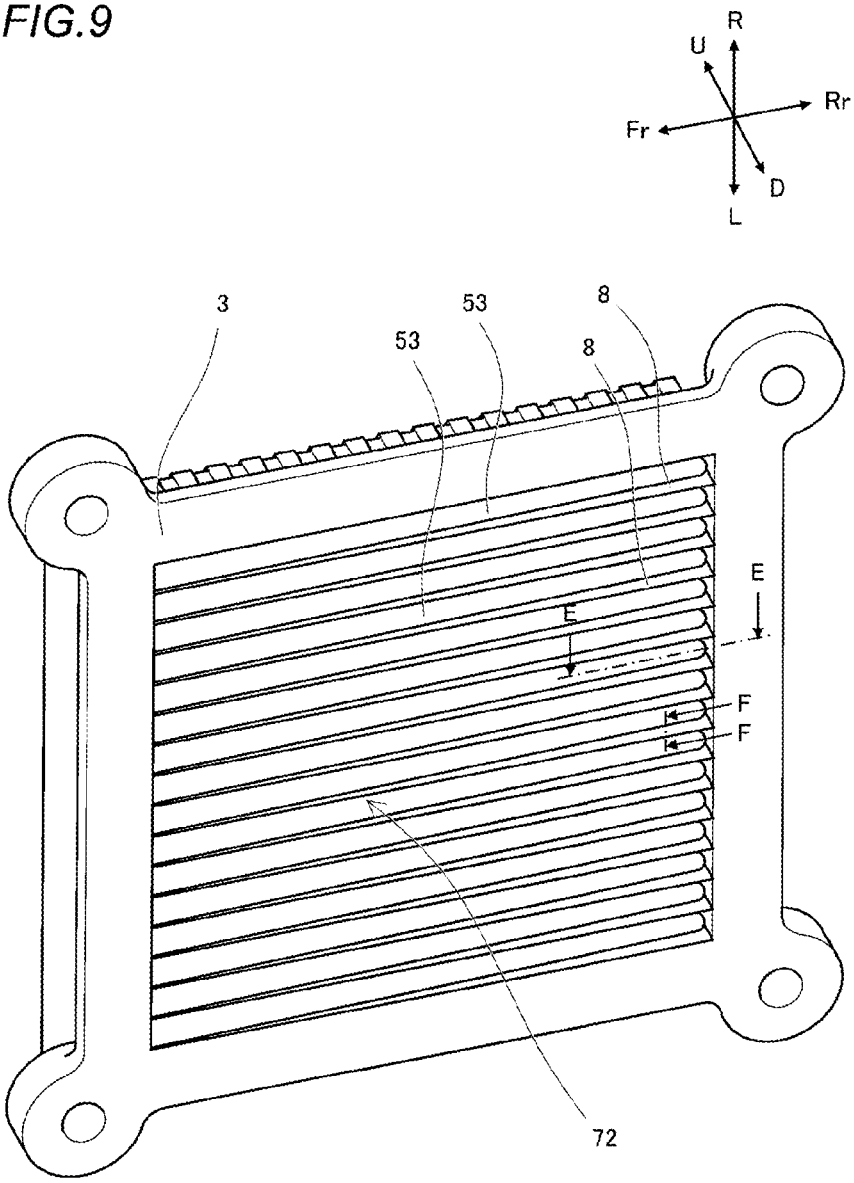
FIG. 9 is a perspective view of a main part in the vicinity of an introduction port 72 in a core portion 3 of the radiator 1.
Figure 10:
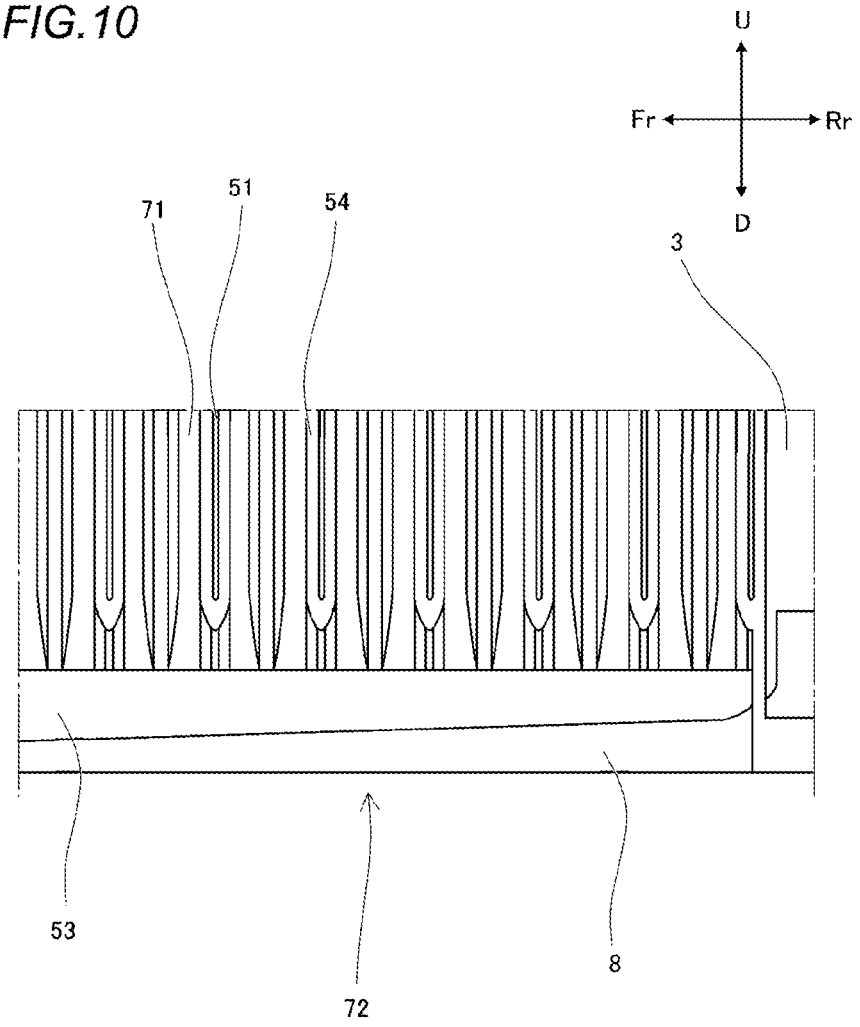
FIG. 10 is a partial cross-sectional view showing a part of a cross section taken along a line E-E in FIG. 9.
Figure 11:
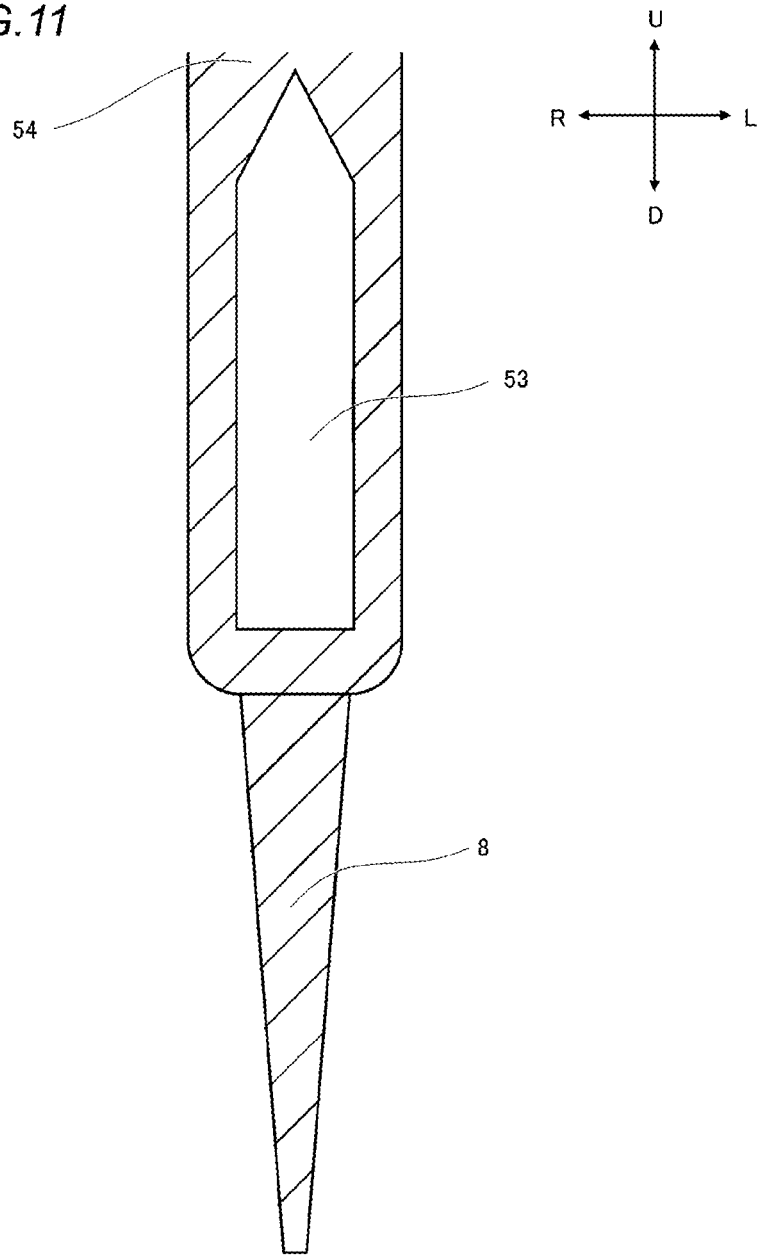
FIG. 11 is a partial cross-sectional view showing a part of a cross section taken along a line F-F in FIG. 9.

As shown in FIGS. 9 to 11, a protection member 8 is formed on the discharge chamber 53.

The protection member 8 extends downward in the upper-lower direction from a lower end of the discharge chamber 53 and extends in the front-rear direction in a substantially thin plate shape. A lower end of the protection member 8 is located on the same plane as the lower end surface of the core portion 3.

Therefore, the protection member 8 can prevent foreign matter from entering the second refrigerant flow path 7. In addition, there is no need to provide a protection member separate from the core portion 3 to prevent foreign matter from entering the second refrigerant flow path 7, and the number of components of the radiator 1 can be reduced. Accordingly, it is possible to prevent the foreign matter from entering the second refrigerant flow path 7 without increasing the number of components of the radiator 1.

Since the air is introduced into the second refrigerant flow path 7 from the introduction port 72, the foreign matter, such as dust and pebbles, is more likely to enter the second refrigerant flow path 7 from the introduction port 72 than from the discharge port 73.

In the present embodiment, the protection member 8 is formed on a side in which the introduction port 72 for introducing the air into the second main flow path 71 of the second refrigerant flow path 7 is provided.

Accordingly, the protection member 8 can more effectively prevent the foreign matter from entering the second refrigerant flow path 7.

As shown in FIG. 11, the protection member 8 has a tapered shape in which a width in the left-right direction decreases toward a lower side.

Accordingly, a plurality of protection members 8 can be arranged in the left-right direction without hindering the flow of the air introduced into the second main flow path 71 through spaces between the plurality of protection members 8 from the introduction port 72.

In the radiator 1 according to the present embodiment, the core portion 3 is formed by additive manufacturing a material. An additive manufacturing method of forming a shape by additive manufacturing a material is one of methods of manufacturing a three-dimensional shape. The additive manufacturing method is a manufacturing method of forming a member having a three-dimensional shape by laminating, based on a three-dimensional model, layers of a material corresponding to continuous cross sections of the three-dimensional model one by one. The additive manufacturing method is also known as a 3D printing technique. Unlike a conventional cutting process of forming a final product by performing cutting on a material block, the final product is formed by laminating a material in the additive manufacturing method, making it possible to form a complicated three-dimensional shape. The additive manufacturing method is also called an additive fabrication method, additive manufacturing, or an additive manufacturing (AM) technique.

In the additive manufacturing method, metal, ceramic, resin, or the like can be used as a material to be laminated. In the present embodiment, the core portion 3 is formed of metal. The core portion 3 may be formed of ceramic, resin, or the like.

In the present embodiment, the core portion 3 is formed by additive manufacturing a material from the lower end surface of the core portion 3. More specifically, the core portion 3 including the first refrigerant flow path 5, the second refrigerant flow path 7, and the protection member 8 is formed by additive manufacturing a material from the lower end surface of the core portion 3.

In general, in the additive manufacturing method, a material cannot be laminated above a space, and thus when the material is laminated from a position spaced a predetermined distance upward from a lower end surface on which the material is to be laminated, the material is laminated from the same plane as the lower end surface to form a support portion, and the material is laminated on an upper surface of the support portion to manufacture a shape. In this case, it is necessary to remove the support portion after manufacturing.

In the present embodiment, the protection member 8 extends downward in the upper-lower direction from the lower end of the discharge chamber 53, and extends in the front-rear direction in a substantially thin plate shape, and the lower end of the protection member 8 is located on the same plane as the lower end surface of the core portion 3.

Therefore, when the core portion 3 is formed by the additive manufacturing method, the discharge chamber 53 can be formed from an upper end of the protection member 8 without forming the support portion below the discharge chamber 53 by additive manufacturing the protection member 8 from the lower end surface of the core portion 3. Accordingly, the core portion 3 can be formed without forming the support portion, and thus a process of removing the support portion after forming the core portion 3 can be omitted, and manufacturability is improved. Further, since the process of removing the support portion after forming the core portion 3 can be omitted, the components of the radiator 1 such as the discharge chamber 53 can be prevented from being damaged in the process of removing the support portion, and thus the quality of the radiator 1 can be improved.

Not only the core portion 3, but also the introduction pipe 11 and the discharge pipe 13 may be integrally manufactured with the core portion 3 by the additive manufacturing method. When the core portion 3, the introduction pipe 11, and the discharge pipe 13 are manufactured separately, a process of assembling the introduction pipe 11 and the discharge pipe 13 to the core portion 3 is required, but this process can be omitted by integral manufacturing using the additive manufacturing method. A predetermined powder material may be resin or metal.

Although an embodiment of the present invention has been described above with reference to the accompanying drawings, it is needless to say that the present invention is not limited to the embodiment. It is apparent that those skilled in the art can conceive of various modifications and alterations within the scope described in the claims, and it is understood that such modifications and alterations naturally fall within the technical scope of the present invention. In addition, components in the above embodiment may be freely combined without departing from the gist of the invention.

For example, in the above embodiment, the radiator 1 including the core portion 3 having a box-like shape has been shown as an example, but the core portion 3 may have a complicated shape that is three-dimensionally curved by the additive manufacturing method.

In the present specification, at least the following matters are described. In parentheses, corresponding components and the like in the above embodiment are shown as an example, but the present invention is not limited thereto.

(1) A heat exchanger (radiator 1), including:

a core portion (core portion 3);

a first refrigerant flow path (first refrigerant flow path 5) provided in the core portion and configured to allow a first fluid (cooling water) to flow therethrough; and a second refrigerant flow path (second refrigerant flow path 7) provided in the core portion and configured to allow a second fluid (air) to flow therethrough, in which in the core portion, the first fluid flowing through the first refrigerant flow path and the second fluid flowing through the second refrigerant flow path exchange heat via a partition wall (partition wall 54), the first refrigerant flow path and the second refrigerant flow path are regularly arranged tubular flow paths, the first refrigerant flow path includes a plurality of first main flow paths (first main flow paths 51) extending in a first direction (upper-lower direction) and arranged in a second direction (front-rear direction) perpendicular to the first direction, an introduction chamber (introduction chamber 52) provided at a first end (upper end) of the plurality of first main flow paths on one side in the first direction, communicating with the plurality of first main flow paths, and extending in the second direction, and a discharge chamber (discharge chamber 53) provided at a second end (lower end) of the plurality of first main flow paths on the other side in the first direction, communicating with the plurality of first main flow paths, and extending in the second direction, and at least one of the introduction chamber and the discharge chamber is formed with a protection member (protection member 8) extending in the first direction from an end opposite to the first main flow path in the first direction toward a direction away from the first main flow path and extending in the second direction.

According to (1), the protection member can prevent foreign matter from entering the second refrigerant flow path. In addition, there is no need to provide a protection member separate from the core portion to prevent foreign matter from entering the second refrigerant flow path, and the number of components of the heat exchanger can be reduced. Accordingly, it is possible to prevent the foreign matter from entering the second refrigerant flow path without increasing the number of components of the heat exchanger.

(2) The heat exchanger according to (1), in which in the first refrigerant flow path, the plurality of first main flow paths arranged in the second direction, the introduction chamber, and the discharge chamber are provided in a plurality of rows arranged in a third direction (left-right direction) orthogonal to both the first direction and the second direction, the second refrigerant flow path includes a plurality of second main flow paths (second main flow paths 71) extending in the first direction and arranged in the second direction, the plurality of second main flow paths arranged in the second direction are formed by being surrounded by the partition wall constituting the first main flow path, and are provided in a plurality of rows arranged in the third direction, an end surface of the core portion on the one side or the other side in the first direction is provided with an introduction port (introduction port 72) configured to introduce the second fluid into the plurality of second main flow paths arranged in the second direction and the third direction, an end surface of the core portion opposite to the introduction port in the first direction is provided with a discharge port (discharge port 73) configured to discharge the second fluid flowing through the plurality of second main flow paths arranged in the second direction and the third direction, and the protection member is formed on a side in which the introduction port is provided in the first direction.

According to (2), the protection member can more effectively prevent the foreign matter from entering the second refrigerant flow path.

(3) The heat exchanger according to (2), in which the protection member has a tapered shape in which a width in the third direction decreases in a direction away from the first main flow path in the first direction.

According to (3), a plurality of protection members can be provided without hindering the flow of the air introduced into the second main flow path through spaces between the plurality of protection members from the introduction port.

(4) A method for manufacturing the heat exchanger according to (1), the method including:

integrally forming the core portion including the first refrigerant flow path, the second refrigerant flow path, and the protection member by additive manufacturing a material.

According to (4), when the core portion is formed by additive manufacturing a material, the core portion can be formed without forming a support portion, and thus a process of removing the support portion after forming the core portion can be omitted, and manufacturability is improved. Further, since the process of removing the support portion after forming the core portion can be omitted, components of the heat exchanger can be prevented from being damaged in the process of removing the support portion, and thus the quality of the heat exchanger can be improved.

REFERENCE SIGNS LIST

1: radiator (heat exchanger)
3: core portion
5: first refrigerant flow path
51: first main flow path
52: introduction chamber
53: discharge chamber
54: partition wall
7: second refrigerant flow path
71: second main flow path
72: introduction port
73: discharge port
8: protection member

What is claimed is:

1. A heat exchanger comprising:

a core portion;

a first refrigerant flow path provided in the core portion and configured to allow a first fluid to flow therethrough; and a second refrigerant flow path provided in the core portion and configured to allow a second fluid to flow therethrough, wherein in the core portion, the first fluid flowing through the first refrigerant flow path and the second fluid flowing through the second refrigerant flow path exchange heat with each other via a partition wall, the first refrigerant flow path and the second refrigerant flow path are regularly arranged tubular flow paths, the first refrigerant flow path comprises a plurality of first main flow paths extending in a first direction and arranged in a second direction perpendicular to the first direction, an introduction chamber provided at a first end of the plurality of first main flow paths on one side in the first direction, communicating with the plurality of first main flow paths, and extending in the second direction, and a discharge chamber provided at a second end of the plurality of first main flow paths on other side in the first direction, communicating with the plurality of first main flow paths, and extending in the second direction, and at least one of the introduction chamber or the discharge chamber is provided with one end communicating with the plurality of first main flow paths and a protection member extending in the first direction from an other end of the at least one of the introduction chamber or the discharge chamber opposite to the one end in the first direction toward a direction away from the first main flow path and extending in the second direction.

2. The heat exchanger according to claim 1, wherein in the first refrigerant flow path, the plurality of first main flow paths arranged in the second direction, the introduction chamber, and the discharge chamber are provided in each of a plurality of rows arranged in a third direction orthogonal to both the first direction and the second direction, the second refrigerant flow path comprises a plurality of second main flow paths extending in the first direction and arranged in the second direction, the plurality of second main flow paths arranged in the second direction are formed by being surrounded by the partition wall constituting the first main flow path, and are provided in each of a plurality of rows arranged in the third direction, an end surface of the core portion on the one side or the other side in the first direction is provided with an introduction port configured to introduce the second fluid into the plurality of second main flow paths arranged in the second direction and the third direction, an end surface of the core portion opposite to the introduction port in the first direction is provided with a discharge port configured to discharge the second fluid flowing through the plurality of second main flow paths arranged in the second direction and the third direction, and the protection member is formed at a side in which the introduction port is provided in the first direction.

3. The heat exchanger according to claim 2, wherein the protection member has a tapered shape in which a width of the protection member in the third direction decreases as the protection member extends away from the first main flow path in the first direction.

4. A method for manufacturing the heat exchanger according to claim 1, the method comprising:

integrally forming the core portion including the first refrigerant flow path, the second refrigerant flow path, and the protection member by additive manufacturing a material.

5. The heat exchanger according to claim 1, wherein the protection member extends in the first direction from a wall, among walls of the other end defining the at least one of the introduction chamber or the discharge chamber.

6. The heat exchanger according to claim 1, wherein the introduction chamber extends in the second direction to allow the first fluid to flow through the introduction chamber in the second direction, and the discharge chamber extends in the second direction to allow the first fluid to flow through the discharge chamber in the second direction.

7. The heat exchanger according to claim 1, wherein in the first refrigerant flow path, the plurality of first main flow paths arranged in the second direction, the introduction chamber, and the discharge chamber are provided in each of a plurality of rows arranged in a third direction orthogonal to both the first direction and the second direction so that the introduction chambers provided in the plurality of rows are provided independently from each other and the discharge chambers provided in the plurality of rows are provided independently from each other.

* * * * *